United States Patent [19]

Achleitner

[11] Patent Number: 4,998,522

[45] Date of Patent: Mar. 12, 1991

[54] METHOD FOR INJECTING FUEL INTO AN INTERNAL-COMBUSTION ENGINE

[75] Inventor: Erwin Achleitner, Regensburg, Fed. Rep. of Germany

[73] Assignee: Siemens Aktiengesellschaft, Berlin and Munich, Fed. Rep. of Germany

[21] Appl. No.: 431,199

[22] Filed: Nov. 3, 1989

[30] Foreign Application Priority Data

Nov. 28, 1988 [EP] European Pat. Off. ..... 88119832.9

[51] Int. Cl.[5] ..... F02D 41/06

[52] U.S. Cl. ..... 123/491

[58] Field of Search ..... 123/179 L, 491, 478

[56] References Cited

U.S. PATENT DOCUMENTS

| | | | |
|---|---|---|---|
| 4,508,083 | 4/1985 | Hasegawa et al. | 123/491 |
| 4,515,131 | 5/1985 | Suzuki et al. | 123/491 |
| 4,562,817 | 1/1986 | Ito | 123/491 X |
| 4,628,882 | 12/1986 | Sakurai et al. | 123/491 X |

FOREIGN PATENT DOCUMENTS

| | | | |
|---|---|---|---|
| 0058561 | 8/1982 | European Pat. Off. . | |
| 137626 | 8/1982 | Japan | 123/491 |
| 59-12137 | 1/1984 | Japan . | |
| 59-99044 | 6/1984 | Japan . | |
| 60-222541 | 11/1985 | Japan . | |
| 60-240875 | 11/1985 | Japan . | |

*Primary Examiner*—Tony M. Argenbright

*Attorney, Agent, or Firm*—Hill, Van Santen, Steadman & Simpson

[57] ABSTRACT

A method for injecting fuel into an internal-combustion engine. In a method for operating an injection system, injection into the individual cylinders is carried out by groups before a synchronization time at which the position of the individual signals is known on the basis of two transmitters. The groups are selected such that an injection into an open intake valve is avoided. Upon transition to the normal, sequential injection, the first cylinder into which injection is carried out is identified such that no double injection at a cylinder occurs. This method avoids a lengthening of the start time due to the lack of injection and also avoids an increased exhaust emission due to bank injection before the synchronization time.

7 Claims, 3 Drawing Sheets

METHOD FOR INJECTING FUEL INTO AN INTERNAL-COMBUSTION ENGINE

BACKGROUND OF THE INVENTION

The present invention is directed to a method for injecting fuel into the cylinders of a multi-cylinder internal-combustion engine.

In a four-cycle internal combustion engine, the crankshaft can cover an angle of 720° dependent on a working cycle, i.e., it executes two full revolutions before a specific cylinder returns to the same working position, for example, at the next ignition time. In order to acquire a momentary position of a cylinder, it is not adequate to identify the angular position of the crankshaft within only a full revolution. Additional information is needed as to whether the engine is currently in a first half or in a second half of the operating cycle, corresponding to the first or second crankshaft revolution.

To that end, it is known in the prior art to provide a static position transmitter whose periodic position signal is composed of two sub-signals, an A-signal and a B-signal that each alternately extend over a full crankshaft revolution. A position transmitter additionally supplies a position signal with a reference pulse per revolution of the crankshaft from which a known angular position, the synchronization position, is identified. In combination with the position signal, the position of the cylinder of the internal-combustion engine can be known precisely only with the detection of the reference pulse and a synchronization of electrical control functions, such as ignition, injection, etc., and the synchronization of the cylinder positions.

After the start of the internal-combustion engine a full crankshaft revolution can pass in the worst case before the synchronization position is reached for the first time. Only then can fuel be injected into the individual cylinders in a proper cycle.

In order to avoid a lengthening of the starting phase due to the absence of fuel injection during the first crankshaft revolution, it is known to simultaneously inject fuel into all cylinders immediately upon starting, this is referred to as bank injection. Dependent on the position of the crankshaft when starting, however, this leads to a double injection into some cylinders after the synchronization time and after the transition to normal injection. Moreover for at least one cylinder, the fuel is injected into the open intake valve, as a consequence whereof an additional increase in the exhaust emission results.

SUMMARY OF THE INVENTION

An object of the present invention is to provide an improved method such that no lengthening of starting time occurs and such that disadvantages of the known bank injection are avoided.

This is a method for injecting fuel into cylinders of a multi-cylinder internal-combustion engine, whereby a normal quantity calculated by a means for control connected to the engine is sequentially injected into the cylinders in a normal sequence following a starting phase and whereby an increased quantity of fuel and a preliminary quantity of fuel is injected during the starting phase. A static position transmitter is connected to a crankshaft of the engine supplying a periodic position signal having two different sub-signals, an A-signal and a B-signal, that extend over a full crankshaft revolution to which a first or second cylinder group is allocated so that a current cylinder group is identified by the present sub-signal. A position transmitter is connected to a crankshaft of the engine that supplies a position signal with a reference pulse per revolution of the crankshaft. The method has the steps of forming every cylinder group from those cylinders whose intake valves are predominantly closed during the allocated sub-signal of the position transmitter; injecting the preliminary quantity of fuel only once into every cylinder of the internal-combustion engine after the recognition of starting, by first triggering the recognition of start injected simultaneously into all cylinders of the current cylinder group and secondly by injecting into the cylinders of the second cylinder group either simultaneously, triggered by the change of the position signal when this occurs before the first reference pulse or sequentially in normal sequence, triggered by the reference pulse when this precedes the change of the position signal and, beginning the sequential injection of the normal quantity with that cylinder that follows the last cylinder of the second cylinder group, whereby this is identified by counting the cylinders in normal sequence from the beginning of the injection into the cylinders of the second cylinder group.

In accord therewith, the first sub-signal of the position transmitter defines a current for a first cylinder group when starting, this first cylinder group being composed of those cylinders whose intake valves are predominantly closed during the first sub-signal. A second cylinder group is composed of those cylinders whose intake valves are predominantly closed during the following sub-signal.

When starting the internal-combustion engine, a preliminary quantity is simultaneously injected into all cylinders of the first cylinder group. As a result an injection of fuel into an open intake valve of a cylinder is predominantly avoided.

After the first signal change of the position signal, the preliminary quantity is simultaneously injected into all cylinders of the second cylinder group insofar as this signal change occurs preceding the synchronization time.

The time for this injection can lie immediately following the signal change, this having the advantage that no additional computational operation is required after the acquisition of the signal change. As in the case of the first cylinder group, an injection of fuel into an open intake valve of a cylinder is thus largely avoided.

In an advantageous improvement of the present invention, the injection of fuel into an open intake valve can be completely avoided. Since the angular position at which the position signal changes is known, an angle by which the crankshaft must continue to turn until none of the intake valves of the second cylinder group is still open can be specified for every internal-combustion engine. The fact that the crankshaft has turned farther by this angle can be identified from the position signal of the position transmitter and the injection can be subsequently triggered. Although a slight additional expenditure for computer function is involved with this method, a further reduction of the exhaust emissions is also achieved.

When, by contrast, the synchronization time precedes the time of the first signal change of the position signal, then the preliminary quantity is already sequentially injected into the cylinders of the second cylinder group according to the known normal sequence. This preliminary quantity is increased in comparison to the normal quantity that is identified by the computer after the starting phase. During starting, it is injected only once per cylinder and, among other things, has the function of building up a wall film in the manifold passage. This preliminary quantity is also injected into the second cylinder group for the same reason when synchronization has already occurred. However, this then occurs in a sequential sequence.

After every cylinder of the internal-combustion engine has received the preliminary quantity once, the known, sequential injection of a normal quantity of fuel begins. This always begins with the cylinder that, for an actual or envisioned sequential injection into the cylinders of the second cylinder group, follows after the last cylinder of this second cylinder group according to the normal sequence. The counting of the cylinders of the second cylinder group in normal sequence begins with the cylinder whose injection time has the shortest chronological spacing from the beginning of the injection into the second cylinder group for a normal sequence.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
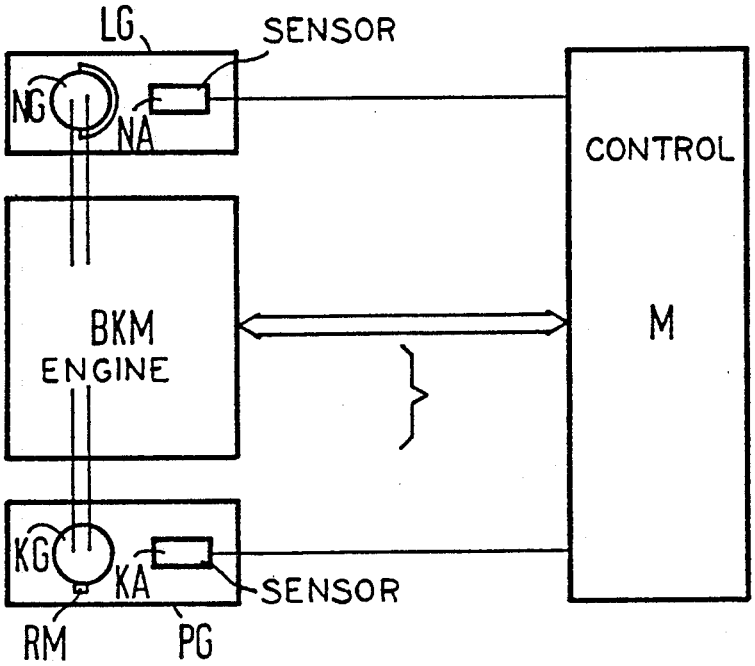
FIG. 1 is a structural diagram of the control of an internal-combustion engine.

In FIG. 1, a standard control means M that controls ignition and fuel injection is operationally connected to an internal-combustion engine BKM. A camshaft transmitter NG in combination with a camshaft sensor NA forms position transmitter LG. The position transmitter generates a static position signal that is composed of two sub-signals having an A-signal (binary "1") for a first, revolution of the crankshaft and a B-signal (binary "0") for the next full revolution of the crankshaft. The position of these sub-signals relative to the positions of the cylinders is freely selectable. In the exemplary embodiment, the center of every sub-signal lies 84° in front of the top dead center of the cylinder having number 1.

The crankshaft transmitter KG having a reference mark RM serves as position transmitter PG in combination with a connected crankshaft sensor KA. This supplies a reference pulse R for each revolution of the crankshaft that defines a synchronization position. The trailing edge of this reference pulse R lies 84° before every top dead center of the cylinder 1. The signal change of the position transmitter lies in the center between two such reference pulses R. This distance is an empirical value for which an especially beneficial signal processing results for a specific internal-combustion engine.

Figure 2:
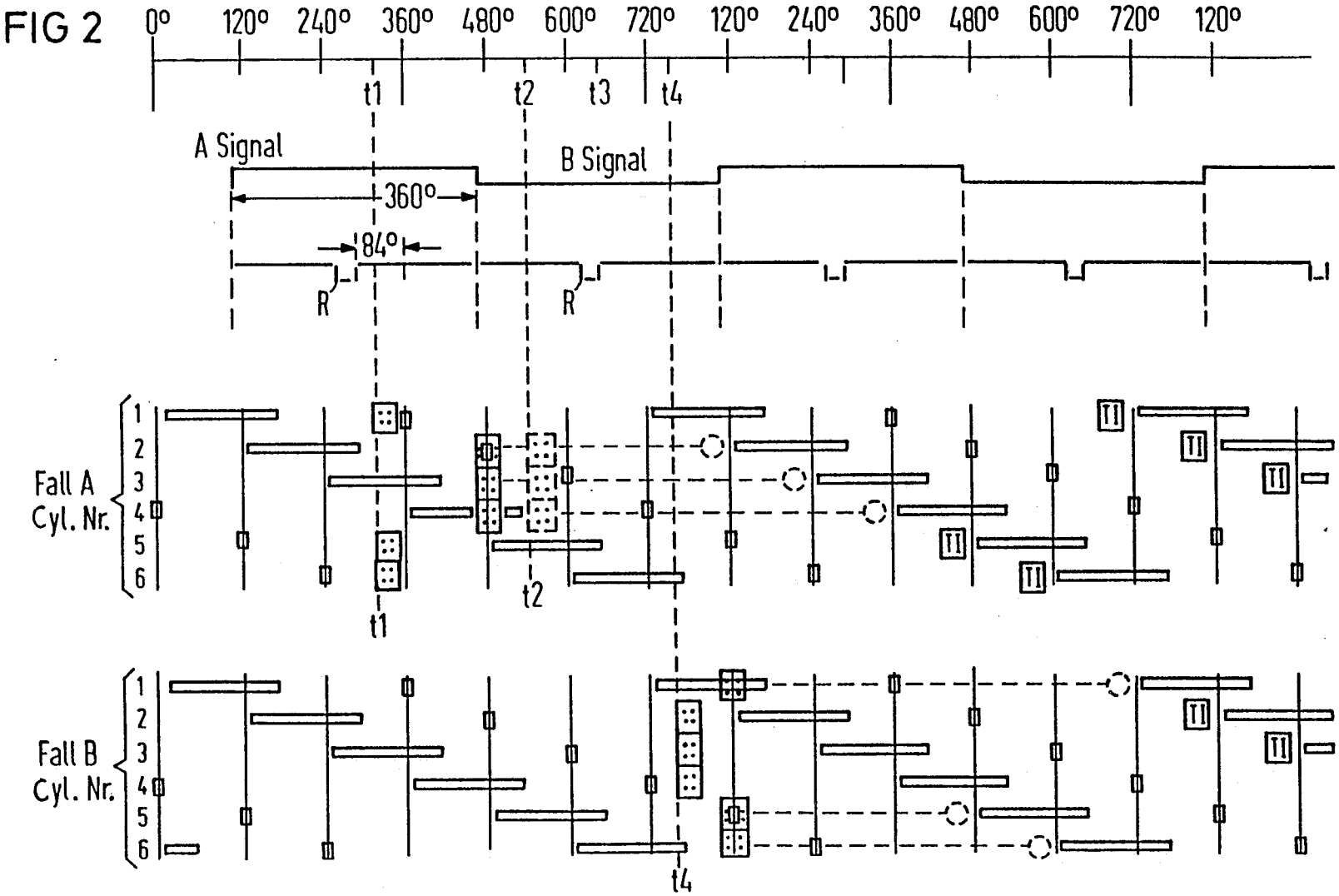
FIGS. 2 and 3 are injection pulse diagrams of four operating cases of a six-cylinder internal-combustion engine.
Figure 3:
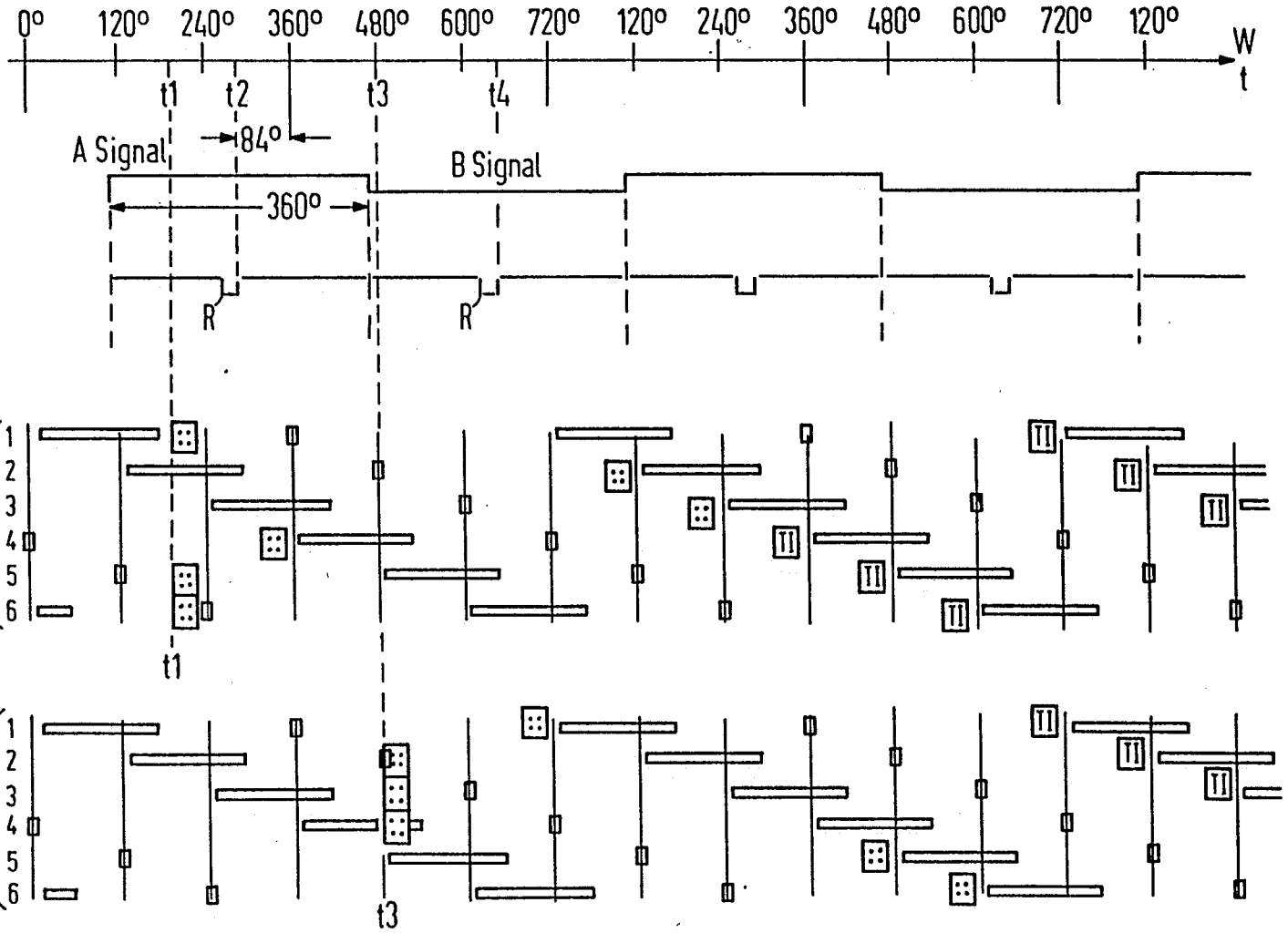

FIGS. 2 and 3 each show two operating cases below one another, whereby the chronologically offset operating cycles of the cylinders 1–6 are entered below one another horizontally from left to right. The position signal composed of alternating A-signal and B-signal, the position signal having the reference pulses R and an angle axis W and time axis t are allocated to them.

Proceeding from the top dead center, the cylinder 1 begins its intake cycle at 0°. Accordingly, the intake valve remains open for the next 180° of the crankshaft revolution. This angular range is indicated with a rectangular bar in the FIGS. The cylinder 1 again reaches its top dead center after 360°, the ignition occurring and the operating cycle beginning in the environment thereof. The ignition range is respectively indicated by a blackened rectangle. After 720° of crankshaft revolution, finally, an operating cycle has been concluded and the intake cycle begins again.

For a six-cylinder engine the operating cycles for the cylinders are offset by 120° relative to one another. The individual cylinders are consecutively numbered in the FIGS. according to their normal sequence during injection and ignition and are shown below one another.

The control means recognizes the start when the RPM of the internal-combustion engine has reached a speed threshold N that, for example, lies at 15 RPM; this is the case in FIG. 2 at time t1 which occurs shortly after the reference pulse R of the position signal. The position transmitter supplies the A-signal at this time and, accordingly, the appertaining, current cylinder group (whose intake valves are predominantly closed) is composed of the cylinders 1, 5 and 6. The preliminary quantity of fuel is injected into these immediately after t1, this being indicated in the FIG. with broken-line squares.

Immediately after the change of the position signal from the A-signal to the B-signal, the preliminary quantity of fuel is injected into the second cylinder group allocated to the B-signal and comprising the cylinders 2, 3 and 4. The intake valve of cylinder 4 is still briefly opened.

A modification is shown with broken lines in FIG. 2. The injection into the second cylinder group here is shifted to time t2 by an angle of approximately 90° kW. Any and all injection into an open intake valve is thus avoided. Time t2 is thereby determined from the position signal.

At time t3, the synchronization time, the first reference pulse R following recognition of start time t1 is then recognized. The normal quantity is sequentially injected in a known, normal sequence from then on, this being indicated in the FIGS. with TI-squares. For identifying the cylinder into which the normal quantity is injected for the first time, the cylinders of the second group are counted in normal sequence beginning with the start of the injection into the second group. For illustration, the normal sequence of the cylinders of the second group is entered as a broken-line circle in cases A and B of FIG. 2. It follows from the illustration that cylinder 4 is the last cylinder of the second group and, thus, the sequential injection with normal quantity begins with the cylinder 5.

It is assumed in FIG. 2 of case B that the start is recognized at time t4 and the injection mode correspondingly changes. The position transmitter supplies a B-signal at time t4 to which the cylinders 2, 3 and 4 are allocated as current cylinder group. These simultaneously receive the preliminary quantity. After the signal change of the position signal to the A-signal, the simultaneous injection of the preliminary quantity into the cylinders 1, 5 and 6 of the second cylinder group then follows. The normal sequence of the cylinders of the second cylinder group, marked with broken-line circles, is then followed by the sequential injection with normal quantity, beginning with cylinder 2.

In case C in FIG. 3, the time t1 of the start recognition and the following reference pulse R (time t2) lie within the same position signal, the A-signal. The preliminary quantity is therefore simultaneously (t1) injected into the allocated cylinder group comprising the cylinders 1, 5 and 6. In this case, however, the synchronization time t2 occurs chronologically before the signal change of the position signal. Accordingly, the cylinders 4, 2, 3 of the next cylinder group already receive the preliminary quantity sequentially, namely, beginning with the cylinder of this group that is the first to follow t2 in the normal sequence, cylinder 4 in this case. The sequential injection is continued with a normal quantity, beginning with cylinder 4, after the injection of the preliminary quantity into the last cylinder, cylinder 3, of this cylinder group.

In a fourth operating case, case D in FIG. 3, the time t3 of the start recognition lies in the region of the B-signal, so that the cylinders 2, 3 and 4 of the allocated cylinder group simultaneously receive the preliminary quantity. The reference pulse R again occurs before the next signal change of the position signal, so that the cylinders 1, 5 and 6 of the next cylinder group receive the preliminary quantity sequentially. The sequential injection with normal quantity then begins with cylinder 1.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A method for injecting fuel into cylinders of a multi-cylinder internal-combustion engine, whereby a normal quantity calculated by a means for control connected to the engine is sequentially injected into the cylinders in a normal sequence following a starting phase and whereby an increased quantity of fuel, a preliminary quantity of fuel, is injected thereinto during the starting phase, a static position transmitter (LG) connected to a crankshaft of the engine and supplying a periodic position signal having two different sub-signals, an A-signal and a B-signal, that extend over a full crankshaft revolution and to which a first or second cylinder group is allocated, respectively, so that a current cylinder group is identified by the respectively present sub-signal, a position transmitter (PG) connected to the crankshaft of the engine and supplying a position signal with a reference pulse (R) per revolution of the crankshaft, the method comprising the steps of:

forming said cylinder groups from those cylinders whose intake valves are predominantly closed during the allocated sub-signal of the position transmitter (LG);

injecting the preliminary quantity of fuel only a single time into every cylinder of the internal-combustion engine after the recognition of starting, by first, triggered by the recognition of start, injecting simultaneously into all cylinders of the current cylinder group and second, injecting into the cylinders of the second cylinder group either simultaneously, triggered by the change of the position signal when this occurs before the first reference pulse (R) or sequentially in normal sequence, triggered by the reference pulse when this precedes the change of the position signal; and beginning the sequential injection of the normal quantity with the cylinder that follows the last cylinder of the second cylinder group, whereby this is identified by counting the cylinders in normal sequence from the beginning of the injection into the cylinders of the second cylinder group.

2. The method according to claim 1, wherein for simultaneous injection into the second cylinder group, the preliminary quantity of fuel is injected immediately after the change of the position signal.

3. The method according to claim 1, wherein for simultaneous injection into the second cylinder group, the preliminary quantity of fuel is injected at a time that follows the change of the position signal by such an angle that none of the intake valves of the second cylinder group is open.

4. The method according to claim 3, wherein the angle is identified from the position signal.

5. A method for injecting fuel into cylinders of a multi-cylinder internal-combustion engine, whereby a normal quantity calculated by a means for control connected to the engine is sequentially injected into the cylinders in a normal sequence following a starting phase and whereby an increased quantity of fuel, a preliminary quantity of fuel, is injected thereinto during the starting phase, a static position transmitter (LG) connected to a crankshaft of the engine and supplying a periodic position signal having two different sub-signals, an A-signal and a B-signal, that extend over a full crankshaft revolution and to which a first or second cylinder group is allocated, respectively, so that a current cylinder group is identified by the respectively present sub-signal, a position transmitter (PG) connected to the crankshaft of the engine and supplying a position signal with a reference pulse (R) per revolution of the crankshaft, the method comprising the steps of:

forming said cylinder groups from those cylinders whose intake valves are predominantly closed during the allocated sub-signal of the position transmitter (LG);

injecting the preliminary quantity of fuel only a single time into every cylinder of the internal-combustion engine after the recognition of starting by first, triggered by the recognition of start, injecting simultaneously into all cylinders of the current cylinder group and second, injecting into the cylinders of the second cylinder group either simultaneously, triggered by the change of the position signal when this occurs before the first reference pulse (R) or sequentially in normal sequence, triggered by the reference pulse when this precedes the change of the position signal;

beginning the sequential injection of the normal quantity with the cylinder that follows the last cylinder of the second cylinder group, whereby this is identified by counting the cylinders in normal sequence from the beginning of the injection into the cylinders of the second cylinder group; and for simultaneous injection into the second cylinder group, the preliminary quantity of fuel being injected immediately after the change of the position signal.

6. A method for injecting fuel into cylinders of a multi-cylinder internal-combustion engine, whereby a normal quantity calculated by a means for control connected to the engine is sequentially injected into the cylinders in a normal sequence following a starting phase and whereby an increased quantity of fuel, a preliminary quantity of fuel, is injected thereinto during the starting phase, a static position transmitter (LG) connected to a crankshaft of the engine and supplying a periodic position signal having two different sub-signals, an A-signal and a B-signal, that extend over a full crankshaft revolution and to which a first or second cylinder group is allocated, respectively, so that a current cylinder group is identified by the respectively present sub-signal, a position transmitter (PG) connected to the crankshaft of the engine and supplying a position signal with a reference pulse (R) per revolution of the crankshaft, the method comprising the steps of:

forming said cylinder groups from those cylinders whose intake valves are predominantly closed during the allocated sub-signal of the position transmitter (LG);

injecting the preliminary quantity of fuel only a single time into every cylinder of the internal-combustion engine after the recognition of starting, by first, triggered by the recognition of start, injecting simultaneously into all cylinders of the current cylinder group and second, injecting into the cylinders of the second cylinder group either simultaneously, triggered by the change of the position signal when this occurs before the first reference pulse (R) or sequentially in normal sequence, triggered by the reference pulse when this precedes the change of the position signal;

beginning the sequential injection of the normal quantity with the cylinder that follows the last cylinder of the second cylinder group, whereby this is identified by counting the cylinders in normal sequence from the beginning of the injection into the cylinders of the second cylinder group; and for simultaneous injection into the second cylinder group, the preliminary quantity of fuel being injected at a time that follows the change of the position signal by such an angle that none of the intake valves of the second cylinder group is open.

7. The method according to claim 6, wherein the angle is identified from the position signal.

* * * * *